US007207697B2

(12) United States Patent
Shoji

(10) Patent No.: US 7,207,697 B2
(45) Date of Patent: Apr. 24, 2007

(54) ILLUMINATION APPARATUS

(75) Inventor: Masao Shoji, Osaka (JP)

(73) Assignee: Cateye Co., Ltd., Osaka (JP)

( * ) Notice: Subject to any disclaimer, the term of this patent is extended or adjusted under 35 U.S.C. 154(b) by 0 days.

(21) Appl. No.: 10/783,613

(22) Filed: Feb. 20, 2004

(65) Prior Publication Data

US 2004/0165388 A1 Aug. 26, 2004

(30) Foreign Application Priority Data

Feb. 25, 2003 (JP) ..... 2003-047790

(51) Int. Cl.
*F21V 17/02* (2006.01)

(52) U.S. Cl. ..... 362/319; 362/187; 362/188; 362/282; 362/304; 362/322; 362/346; 362/512; 362/514; 362/520

(58) Field of Classification Search ..... 362/187, 362/188, 241, 35, 282, 319, 322, 512, 267, 362/520, 304, 346, 514
See application file for complete search history.

(56) References Cited

U.S. PATENT DOCUMENTS

| | | | | |
|---|---|---|---|---|
| 4,530,040 | A | 7/1985 | Petterson | 362/188 |
| 5,138,540 | A * | 8/1992 | Kobayashi et al. | 362/268 |
| 5,178,452 | A | 1/1993 | Scholz | 362/319 |
| 5,490,045 | A * | 2/1996 | Lindner | 362/35 |
| 5,749,645 | A * | 5/1998 | Maglica | 362/205 |
| 6,334,702 | B1 | 1/2002 | Albou | 362/514 |
| 2002/0030998 | A1 * | 3/2002 | Natsume | 362/509 |

FOREIGN PATENT DOCUMENTS

| | | |
|---|---|---|
| DE | 535057 | 10/1981 |
| DE | 86 22 788.2 U1 | 8/1988 |
| DE | 40 16 531 A1 | 11/1991 |
| DE | 40 23 408 A1 | 1/1993 |
| DE | 19632189 | 2/1998 |
| EP | 0380663 A1 | 8/1990 |
| EP | 0 648 971 A1 | 4/1995 |
| EP | 0 929 774 B1 | 7/1999 |
| EP | 0 974 786 | 1/2000 |
| EP | 0974786 | 1/2000 |
| FR | 654983 | 4/1929 |
| FR | 998361 | 1/1952 |
| FR | 2657146 A1 | 7/1991 |
| JP | 06176608 A2 | 6/1994 |
| JP | 2002-050212 | 2/2002 |
| JP | 2002-050213 | 2/2002 |
| WO | WO 96/27102 | 9/1996 |
| WO | WO 02/14738 | 2/2002 |
| WO | WO 02/14738 A1 | 2/2002 |

* cited by examiner

*Primary Examiner*—Stephen F. Husar
*Assistant Examiner*—Meghan K. Dunwiddie
(74) *Attorney, Agent, or Firm*—Olson & Hierl, Ltd.

(57) ABSTRACT

An illumination apparatus is provided that has sufficiently high efficiency irrespective of a size of a light source. The illumination apparatus projecting light forward includes an LED chip, a small-diameter reflecting mirror positioned in front of the LED chip for receiving light from the LED chip to project the light forward, and a reflecting mirror enclosing the LED chip and the small-diameter reflecting mirror for directing and reflecting forward the light from the LED chip.

5 Claims, 9 Drawing Sheets

ILLUMINATION APPARATUS

BACKGROUND OF THE INVENTION

1. Field of the Invention

The present invention relates to an illumination apparatus, and more specifically to an illumination apparatus with high efficiency to allow a prescribed pattern to be formed efficiently even when a size of a light source is too large to be considered as a point source.

2. Description of the Background Art

Conventional illumination apparatuses have been formed as follows.

(a) Light emitted from a filament arranged in the vicinity of a focus of a paraboloid extends in all directions and is reflected on the paraboloid to form parallel rays. The parallel rays are formed into a desired light distribution pattern by a front lens (for example, see Japanese Patent Laying-Open Nos. 2002-50212 and 2002-50213).

(b) Light emitted from a filament is formed into a desired light distribution pattern by a multi-surface mirror and is then projected forward. A front lens only serves as a cover. The multi-surface mirror includes components each having a size and an angular arrangement as determined such that the component reflects the light entering from the filament into a prescribed direction and the combination of the components results in a desired light distribution pattern (see the patent specifications as listed above).

A desired light distribution pattern has been obtained efficiently using such illumination apparatuses.

Recently, high-power LEDs (Light Emitting Diode) have been commercially available to provide a light source with an extremely high luminosity. Such a high-power LED is large in size, and with a conventional light distribution structure of a illumination apparatus where a light source is regarded as a point source, a large amount of light emission thereof cannot be fully utilized. Therefore, the efficiency is inevitably reduced.

In particular, when reducing the size of illumination apparatuses is pursued, efficiency reduction caused by increased disorder of light distribution is more likely to be brought about. A light source is arranged, for example, in the vicinity of a focus of a reflecting mirror of an illumination apparatus. When the reflecting mirror is reduced in size with its focal length reduced, the light, for example, from a location shifted from the focus of the filament does not radiate as intended, resulting in disorder of light distribution and reduced efficiency. In other words, even if the light source is of the same size, miniaturization increases the influence of displacement at the location shifted from the focus of the light source and increase the disorder of light distribution. Therefore, the valuable high-power LED cannot be used efficiently.

SUMMARY OF THE INVENTION

Therefore, an object of the present invention is to provide an illumination apparatus capable of having sufficiently high efficiency for every light source including a large-size light source.

An illumination apparatus in accordance with the present invention projects light forward. The illumination apparatus includes: a light source; forward projecting means positioned in front of the light source for receiving light from the light source to project the light forward; and a reflecting mirror enclosing the light source and the forward projecting means for directing and reflecting forward the light from the light source.

With this configuration, when the light source is too large to be regarded as a point, the forward projecting means can receive the light directed forward from the light source to project it forward. Furthermore, among the light beams emitted and spread out from the light source, the light beam projected on the reflecting mirror can be reflected forward by the reflecting mirror. As a result, the light distribution pattern can be formed by two light distribution mechanisms of the forward projecting means and the reflecting mirror, and the degree of freedom in forming a light distribution pattern is increased. Therefore, disorder of a light distribution pattern can be prevented and high efficiency can be assured.

If there exists light passing between the forward projecting means and the reflecting mirror, light that does not reach either of them diverges and contributes to wide illumination of the nearby area. Usually, the two light distribution mechanisms described above are arranged such that no light passes in such a manner as described above. Furthermore, when the forward projecting means is formed of a reflecting mirror or the like, even the light reaching within the range of the forward projecting means is not reflected or refracted but projected forward while keeping traveling in a straight line from the light source and diverging in the vicinity of the center axis.

The light source may be a filament or an LED chip. The light source may have any size.

The reflecting mirror may be a parabolic mirror, and the light source may be positioned on a focus of the parabolic mirror.

With this configuration, even when the configuration of the forward projecting means is varied, for example, if the distance between the light source and the forward projecting means is varied, the light arriving at the parabolic mirror from the light source is projected forward with a good directivity as parallel rays parallel to the optical axis. Therefore, even if the illumination range ahead is expanded by an operation of varying the position of the forward projecting means or the like, the illuminance at the center region ahead can always be kept at a certain level or higher.

The forward projecting means may be a Fresnel lens having a stepped surface arranged on a plane on opposite side of the light source. A transparent air-blocking means may be provided in front of the Fresnel lens to prevent the Fresnel lens from being exposed to the air.

In the configuration as described above, the Fresnel lens is a convex lens and can project parallel rays forward with arrangement of the light source at its focal position. In the Fresnel lens, the surface of the convex lens is provided with ring-shaped steps. Therefore, the Fresnel lens has an exposed step surface between the ring and the adjacent inner ring. As a result, the stepped surface of the Fresnel lens has such a convex lens surface that is radially tapered with some levels. If dusts and the like are deposited on the corner of the level, they are hardly removed. Therefore, conventionally, during the use of the Fresnel lens, the stepped surface is usually not directed forward and is arranged to face toward the light source, wherein dusts hardly adhere.

When the stepped surface is arranged to face toward the light source, the exposed step surface is also irradiated with light from the light source. The exposed step surface is a surface that would not exist on a surface of a convex lens and is irrelevant with the optical system. Therefore, the light applied on the exposed step surface is ineffective light in which parallel rays are not projected forward. This is a major factor of efficiency reduction in projecting light forward using the Fresnel lens.

By arranging the stepped surface to face forward on the opposite side of the light source and by arranging the transparent air-blocking means to prevent the stepped surface from being exposed to outside air, as described above, high efficiency can be assured and deposition of dusts and the like can be prevented.

The forward projecting means may be a small-diameter reflecting mirror having an aperture smaller than that of the reflecting mirror.

In this configuration using two, large and small reflecting mirrors, the small-diameter reflecting mirror can project forward the light at the center of the light source, and the reflecting mirror enclosing it can project forward all the light beams reaching its reflecting surface, of the remaining light. Furthermore, the light not reaching either of them diverges and contributes to wide illumination of the nearby surrounding area. Among the light beams reaching within the range of the small-diameter reflecting mirror, the beams in the vicinity of the center axis is not reflected by the small-diameter reflecting mirror and diverges as they are from the light source to be projected forward. Either of the reflecting mirror and the small-diameter reflecting mirror has an aperture that can be determined as the average diameter at the front end thereof, for example.

A distance varying means may be provided that can vary a distance between the forward projecting means and the light source.

With this configuration, the amount of light reaching the forward projecting means from the light source can be varied. Therefore, a light distribution pattern can be changed while the intensity of light at the forward center region is maintained. In addition, the efficiency can also be changed.

The distance varying means may be a screw mechanism provided between a light source-fixing member fixing the light source and a forward projecting means-fixing member fixing the forward projecting means. With this configuration, the distance varying means can easily be formed.

An LED (Light Emitting Diode) may be used for the light source. With this configuration, a long-life illumination apparatus can be obtained by making use of the longevity of LED.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The embodiments of the present invention will now be described with reference to the figures.

(First Embodiment)

Figure 1:
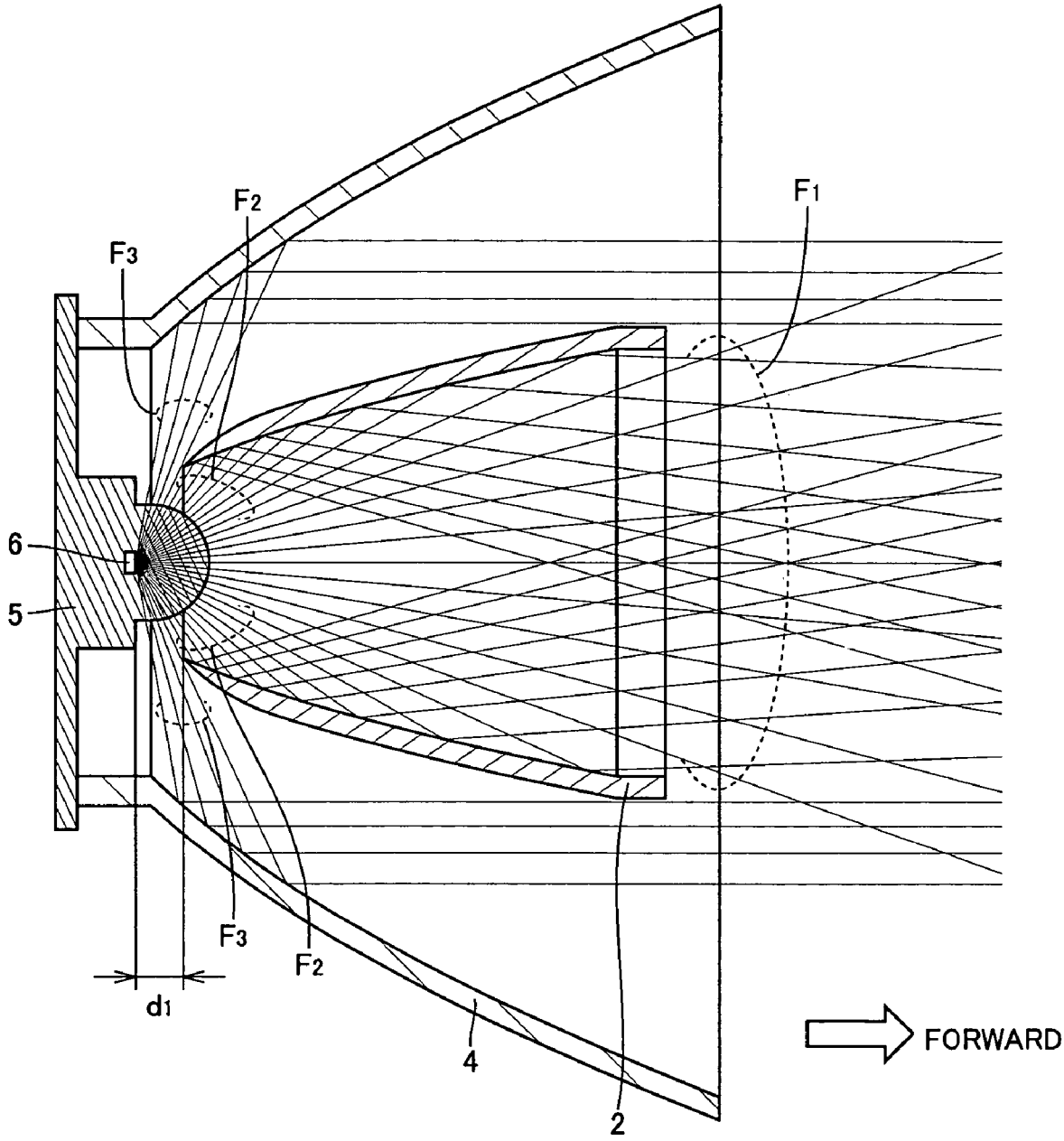
FIG. 1 shows an illumination apparatus in a first embodiment of the present invention.

In FIG. 1, an LED device 5 is provided with an LED chip 6 serving as a light source to allow a high-power light emission. This LED chip has a surface-emitting portion of 1.0 mm×1.0 mm, from which light is emitted. In front of LED chip 6, a small-diameter reflecting mirror 2 having a tapered tubular shape is arranged at a position of a distance d1. A reflecting mirror 4 having an aperture larger than that of small-diameter reflecting mirror 2 is arranged to enclose LED chip 6 and small-diameter reflecting mirror 2. Unlike a filament, the LED chip does not emit light isotropically. In other words, it does not emit light backward but emits light in a range ahead of a plane including a substrate surface of the LED chip. Reflecting mirror 4 is a rotating parabolic mirror and has its focus arranged with the LED chip.

Light F1 emitted from LED chip 6 at a small inclination angle with respect to the optical axis enters small-diameter reflecting mirror 2 and passes through the small-diameter reflecting mirror as it is without reaching the reflecting surface. Therefore, light F1 diverges widely, for example, at a position 10 m ahead. Light F2 emitted at an inclination angle larger than that of light F1 with respect to the optical axis is reflected on the reflecting surface of small-diameter reflecting mirror 2 and is projected forward at the inclination angle close to that of F1.

Light F3 emitted from LED chip 6 at an inclination angle larger than that of light F2 passes outside the range of the small-diameter reflecting mirror and is reflected on the reflecting surface of reflecting mirror 4 to form parallel rays parallel to the optical axis to be projected forward. This part of light F3 serves as light illuminating the center region, for example, at a position 10 m ahead.

In the arrangement of FIG. 1 where the small-diameter reflecting mirror is proximate to the light source, the proportion of light F1 passing through the small-diameter reflecting mirror as it is and light F2 reflected at the small-diameter reflecting mirror is high. In addition, the light reflected at the small-diameter reflecting mirror is projected forward at a large inclination angle with respect to the optical axis. Therefore, in the arrangement of FIG. 1, light is distributed very widely. However, because of light F3 as described above, the illuminance at the center region can be sufficiently obtained, for example, at the position 10 m ahead.

Figure 2:
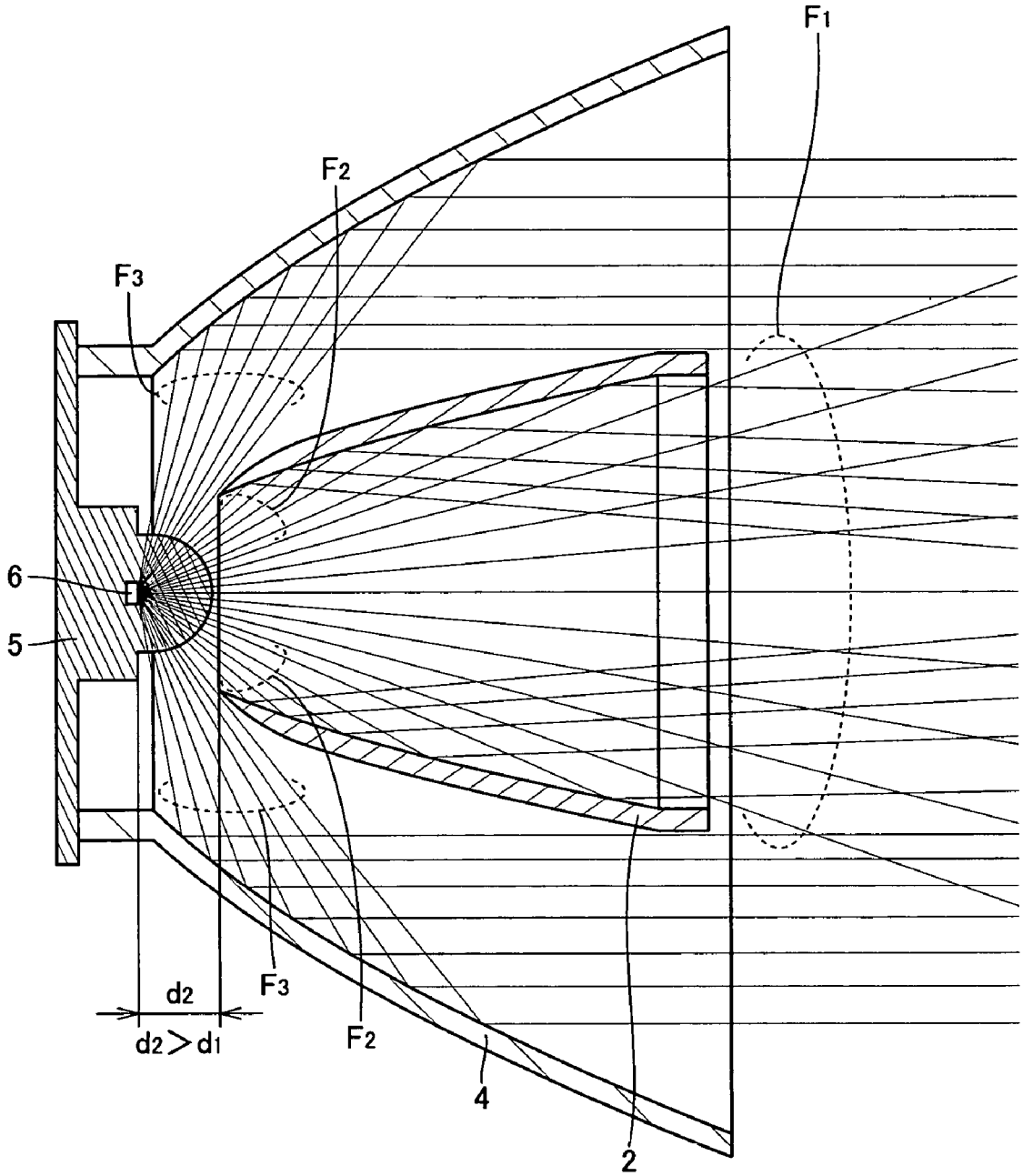
FIG. 2 shows the illumination apparatus of FIG. 1 with a small-diameter reflecting mirror shifted forward.

FIG. 2 illustrates a light distribution characteristic in the case where small-diameter reflecting mirror 2 is arranged spaced apart from LED chip 6 at a distance d2 greater than distance d1 in FIG. 1. As a matter of course, the separation of small-diameter reflecting mirror 2 from light source 6 can increase the amount of light F3 directed toward reflecting mirror 4. Therefore, the illuminance at the center region ahead can be increased. Furthermore, since the inclination angle with respect to the optical axis of the light reflected on the reflecting surface of the small-diameter reflecting mirror and then projected forward is small, the degree of divergence is reduced, thereby increasing the center intensity.

As the amount of light F1 passing through small-diameter reflecting mirror 2 as it is decreases, the amount of diverging light decreases. However, this amount of light is not so large as to affect the illuminance at the center region to increase the illuminance at the center region ahead.

Figure 3:
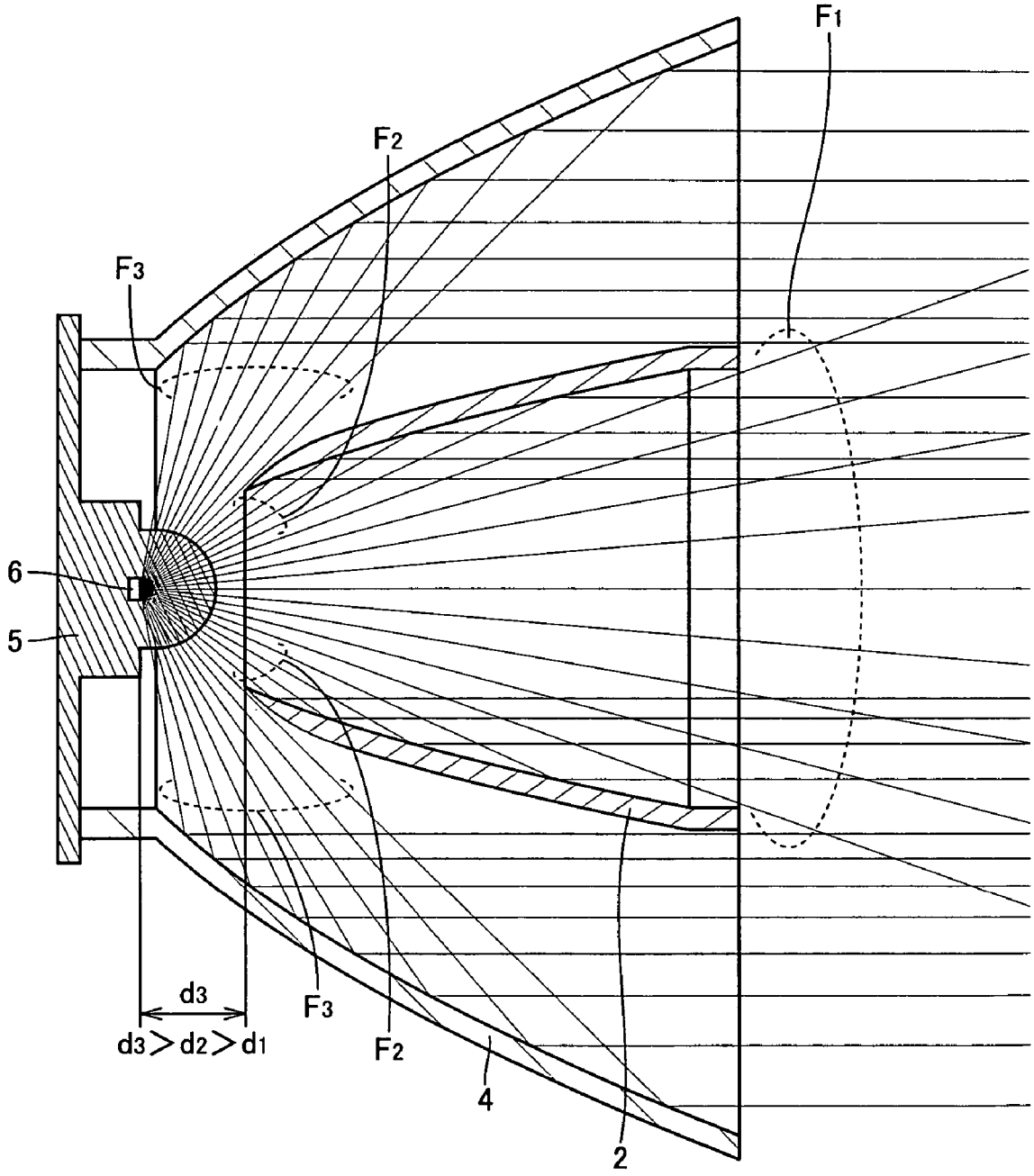
FIG. 3 shows the illumination apparatus of FIG. 2 with a small-diameter reflecting mirror shifted further forward.

FIG. 3 illustrates a light distribution characteristic in the case where small-diameter reflecting mirror 2 is arranged spaced apart from LED chip 6 at a distance d3 greater than distance d2 in FIG. 2. In this case, the amount of light F3 reflected on the reflecting mirror increases, and therefore the proportion of the light parallel to the optical axis increases. Light F2 reflected at the small-diameter reflecting mirror is projected forward as parallel rays approximately parallel to the optical axis. The proportion of light F1 passing through the small-diameter reflecting mirror decreases. Therefore, the light distribution pattern, for example, at a position 10 m ahead is such that the illuminance at the center region is extremely high and the illuminance at the peripheral region is low.

Figure 4:
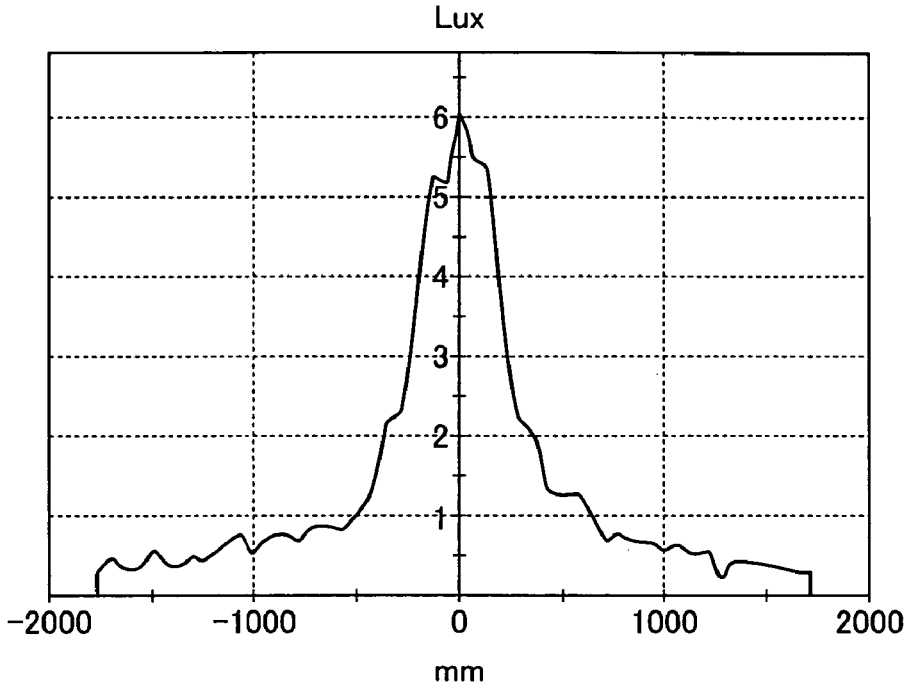
FIG. 4 shows a light distribution pattern at a position 10 m ahead of the illumination apparatus of FIG. 1.
Figure 5:
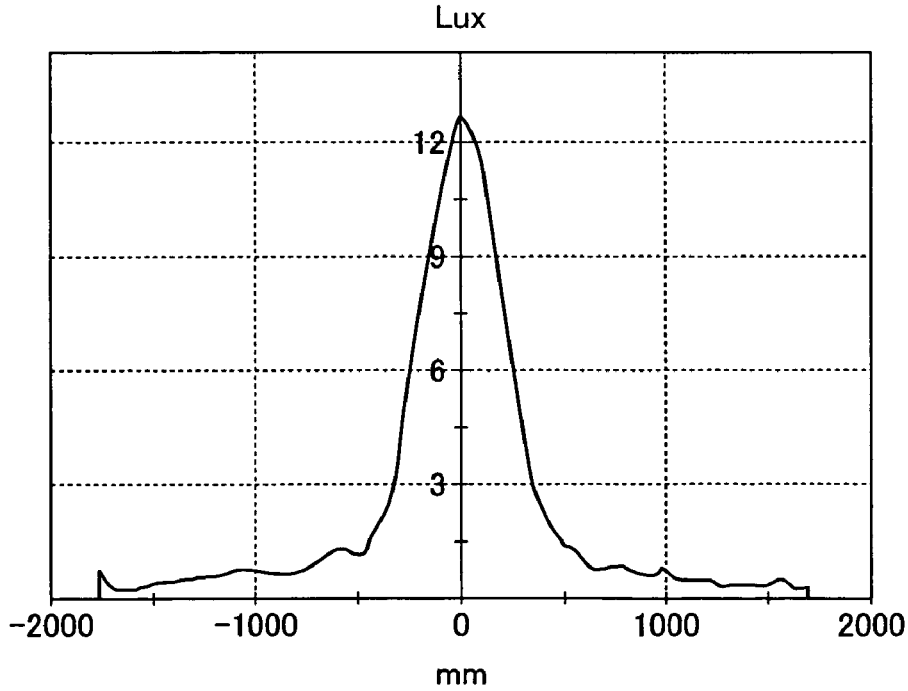
FIG. 5 shows a light distribution pattern at a position 10 m ahead of the illumination apparatus of FIG. 2.
Figure 6:
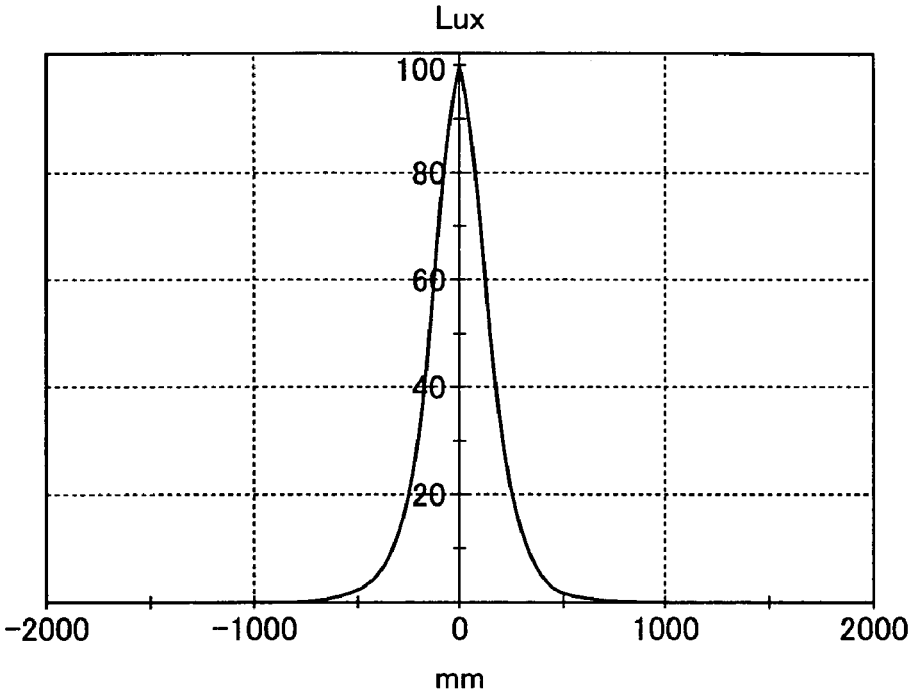
FIG. 6 shows a light distribution pattern at a position 10 m ahead of the illumination apparatus of FIG. 3

FIGS. 4–6 show light distribution patterns at a position 10 m ahead, which correspond to the arrangements of FIGS. 1–3, respectively. FIG. 4 shows that light distribution extends corresponding to the light distribution pattern in which the illuminance is low at the center region and high at the periphery, as illustrated in FIG. 1. However, the peak at the center region is clear, approximately at 6 Lux. In other words, it can be understood that the illuminance at the center region can be kept at a certain level or higher even when the light distribution is expanded.

FIG. 5 shows a light distribution pattern with distance d2 between LED chip 6 and small-diameter reflecting mirror 2. The illuminance at the center region exceeds 12 Lux, and it can be understood that the illuminance at the center region is enhanced. Furthermore, the illuminance of about 1 Lux can be obtained even at a position approximately 1 m away from the center.

FIG. 6 shows a light distribution pattern at a position 10 m ahead, which corresponds to the arrangement of FIG. 3. As light F2 reflected at the small-diameter reflecting mirror is projected forward parallel to the optical axis, the illuminance at the center region is extremely high, reaching 100 Lux. Furthermore, the illuminance at a position 1 m away from the center is zero. It can be understood that the light is well focused to illuminate the central position ahead.

By using two light distribution mechanisms of the reflecting mirror and the small-diameter reflecting mirror and by varying the distance between the light source and the small-diameter reflecting mirror, as described above, the light distribution can be spread out or narrowed with the illuminance at the center ahead being kept at a certain level or higher. In this case, as compared with the conventional example, high efficiency can be obtained, which will be described later.

Figure 7:
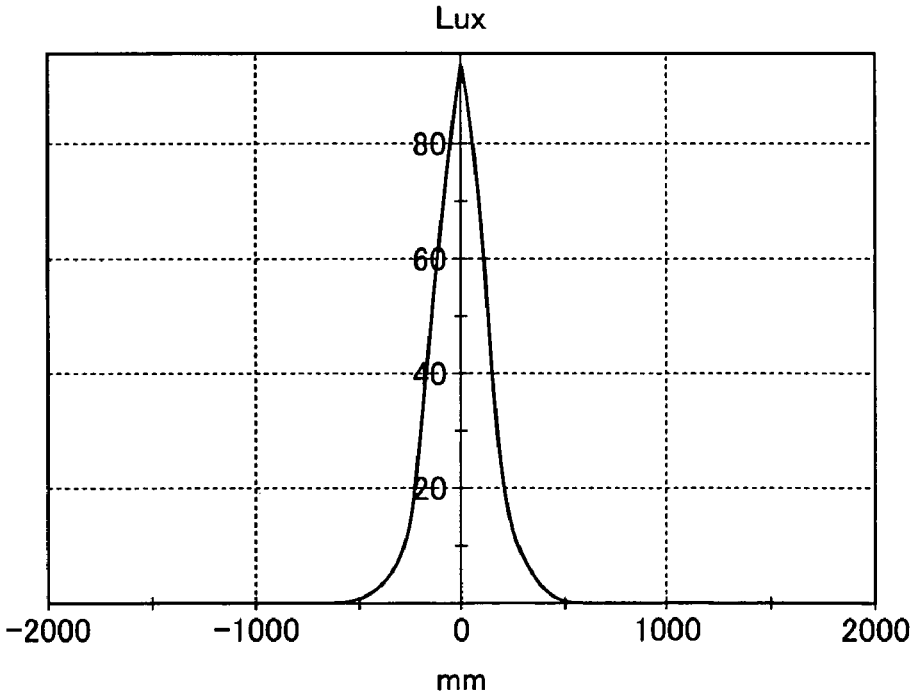
FIG. 7 shows a light distribution pattern at a position 10 m ahead of an illumination apparatus as a first comparative example.

For comparison, a distribution pattern in the case where the small-diameter reflecting mirror as described above is not arranged, will be described. FIG. 7 shows a light distribution pattern at a position 10 m ahead where the small-diameter reflecting mirror is not arranged. In this case, the light reaching the reflecting mirror and being reflected on the reflecting mirror is projected forward as light rays parallel to the optical axis. As a result, the illuminance at the center region is as high as over 90 Lux. However, as compared with FIG. 6 showing the light distribution pattern where light is collected at the center region in the present embodiment, the peak value is slightly lower and the width is narrower. It can be understood that this example is clearly inferior in terms of the efficient use of light from the light source. By contrast, the illumination apparatus in the first embodiment of the present invention can have excellent efficiency as compared with the conventional example.

Figure 8:
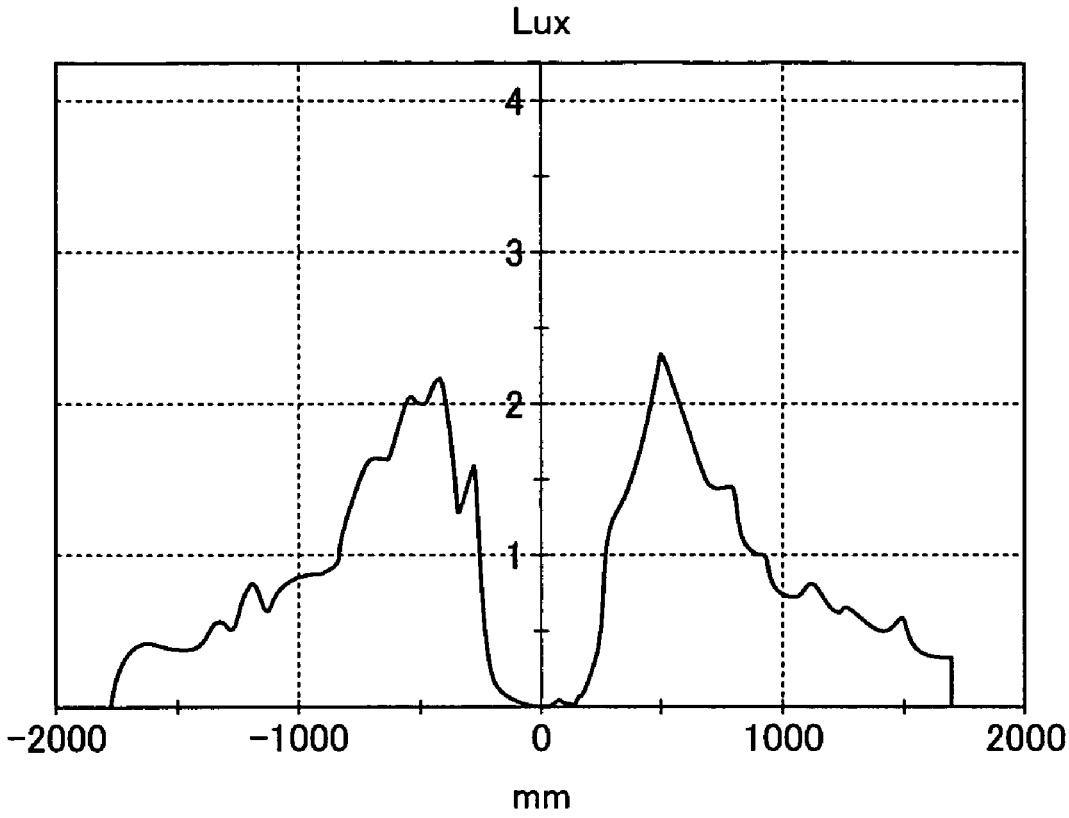
FIG. 8 shows a light distribution pattern at a position 10 m ahead of an illumination apparatus with a light source shifted 5 mm in a lateral direction as a second comparative example.

FIG. 8 shows a light distribution pattern at a position 10 m ahead where the small-diameter reflecting mirror is not arranged and the LED chip is shifted 5 mm from the center in FIG. 1. In this arrangement, the light distribution range is expanded at the position 10 m ahead, thereby achieving the purpose of expanding illumination. However, the illuminance is extremely reduced at the center region, resulting in doughnut-shaped illumination. In the present embodiment, expansion of illumination does not result in doughnut-shaped illumination, and the illumination range can be expanded while the illuminance at the center region is assured.

Figure 9:
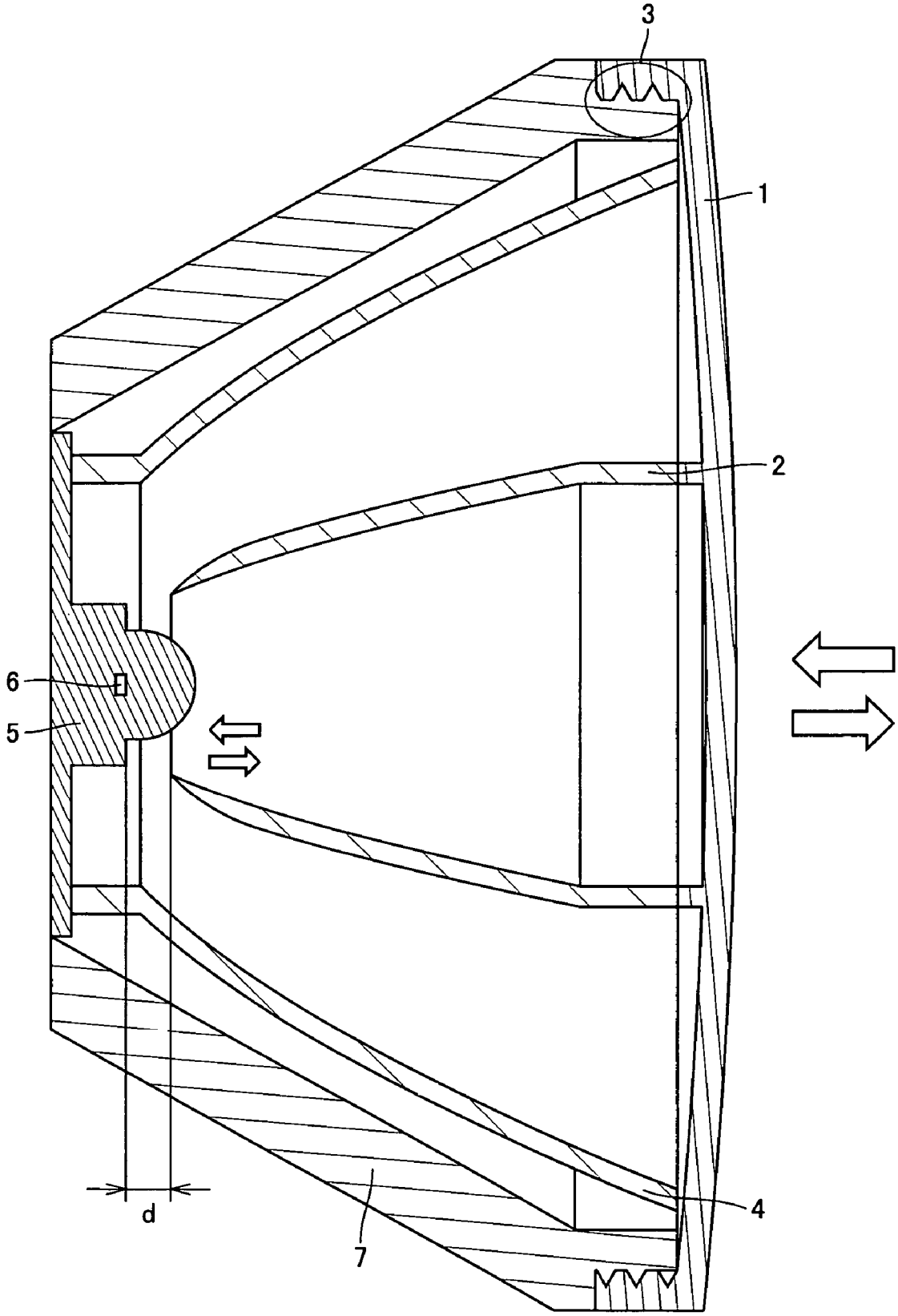
FIG. 9 shows a mechanism for moving the small-diameter reflecting mirror in the illumination apparatus in the first embodiment of the present invention.

FIG. 9 shows a mechanism for moving the small-diameter reflecting mirror as shown in FIGS. 1–3. In this illumination apparatus, LED device 5 and reflecting mirror 4 are integrally formed, and a light source-fixing member 7 for fixing LED device 5 is integrated with the LED device. Therefore, LED device 5 including LED chip 6, reflecting mirror 4 and light source-fixing member 7 are connected to each other for integration.

A transparent protective cover 1 positioned at the front of this illumination apparatus is connected and integrated with small-diameter reflecting mirror 2. This protective cover is a forward projecting means-fixing member. The protective cover is screwed to light source-fixing member 7 with a screw mechanism 3. Distance d between LED chip 6 and small-diameter reflecting mirror 2 can be adjusted by adjusting the length of the screw portion. More specifically, distance d between LED chip 6 and the small-diameter reflecting mirror is changed during the use of the illumination apparatus by turning protective cover 1 by one hand, in order to vary the illumination range ahead.

In doing so, irrespective of variations of distance d, the positional relationship between reflecting mirror 4 and LED chip 6 serving as a light source is not changed. Therefore, with any variation of distance d, the illuminance at the center region ahead can be kept at a certain level or higher. On that condition, the degree of extension of forward light distribution from the center to the outside can be adjusted by varying distance d.

In addition, what is important is that two light distribution mechanisms are effectively used for the same light source to provide illumination with higher efficiency than the conventional example, as described above. This is because the light emitted from the light source is received by two light distribution mechanisms and then projected forward, so that the available quantity of light is increased as compared with the conventional example.

(Second Embodiment)

Figure 10:
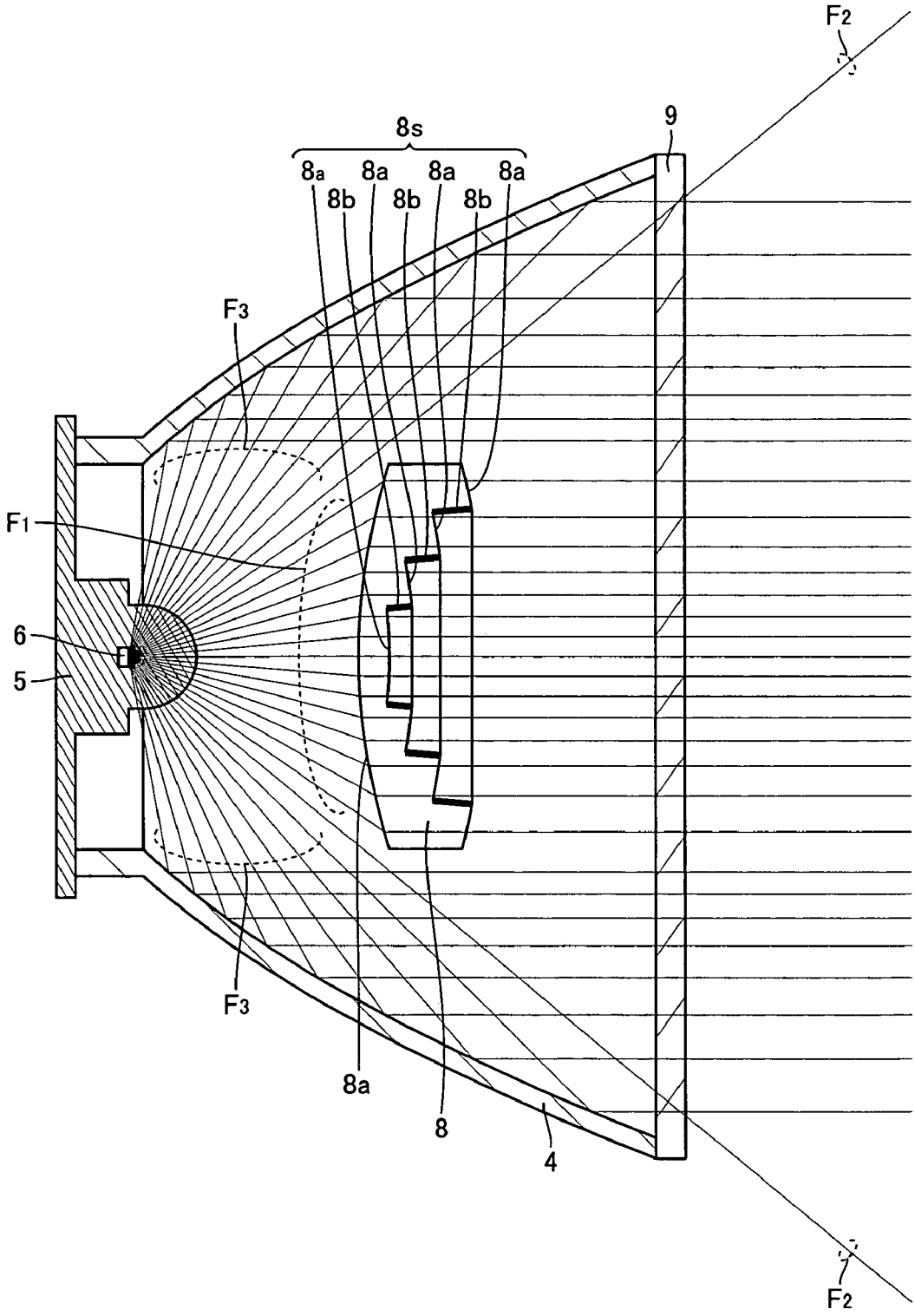
FIG. 10 shows an illumination apparatus in a second embodiment of the present invention.

FIG. 10 shows an illumination apparatus in a second embodiment of the present invention. In FIG. 10, a Fresnel lens 8 that is a forward projecting means is arranged in front of the LED chip with a stepped surface 8*s* facing forward. The second embodiment differs from the first embodiment in that the small-diameter reflecting mirror is replaced with Fresnel lens 8 as the forward projecting means and that a transparent protective cover 9 is provided. The other parts are the same with the first embodiment. More specifically, LED chip 6 is positioned at the focus of a rotating parabolic mirror serving as a reflecting mirror, and the light reaching the reflecting mirror is projected ward as parallel rays parallel to the optical axis.

Fresnel lens 8 functions similar to a convex lens. The LED chip is arranged at the focus of the Fresnel lens, so that the light reaching the Fresnel lens from the light source is projected forward as parallel rays parallel to the optical axis, thereby improving the illuminance at the center region ahead. Furthermore, the distance between the Fresnel lens and the LED chip is reduced as compared with the arrangement shown in FIG. 10, so that the light projected forward from the Fresnel lens is expanded, thereby increasing the illuminance in an extended region outside the center region ahead.

Figure 11:
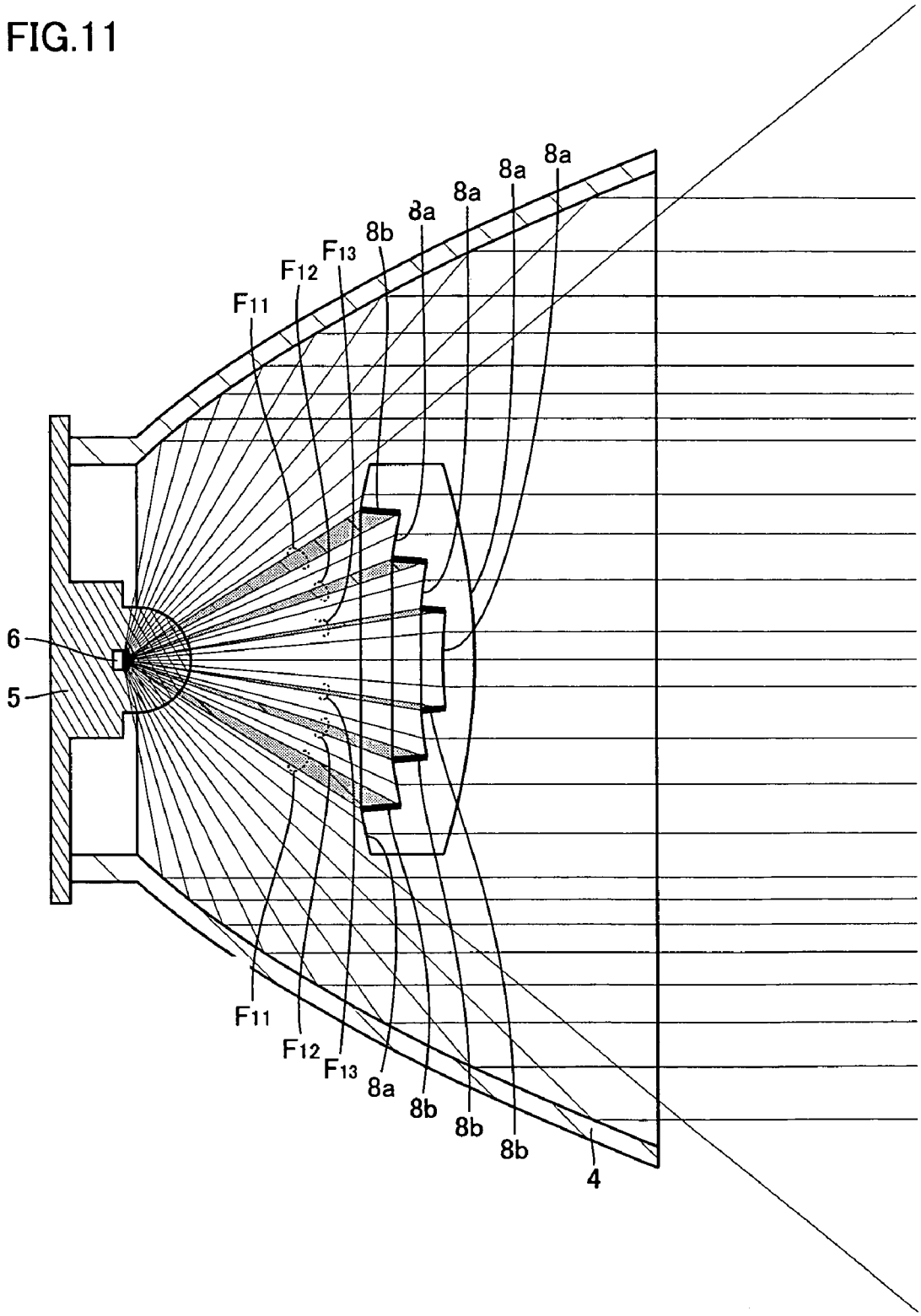
FIG. 11 shows an illumination apparatus as a third comparative example.

In FIG. 10, stepped surface 8*s* of the Fresnel lens is faced forward on the opposite side of the light source, so that no light reaches exposed step surface 8*b* directly from the light source and all the light beams reaching the Fresnel lens are effectively projected forward. By contrast, as shown in FIG. 11, when stepped surface 8*s* is arranged at the light source side, lights F11, F12, F13 of the light from the light source directly radiate on exposed step surface 8*b*. As described above, the exposed step surface is a surface that would not exist on a surface of a convex lens and is irrelevant with surface 8*a* of the optical system. Therefore, lights F11, F12, F13 applied on the exposed step surface are ineffective light in which parallel rays are not projected forward. This is a major factor of efficiency reduction in projecting light forward using a Fresnel lens.

By arranging the stepped surface to face forward on the opposite side of the light source and by arranging transparent protective cover 9 to prevent the stepped surface from being exposed to outside air, high efficiency can be assured and deposition of dusts and the like can be prevented.

In FIG. 10, lights F1, F3 reaching Fresnel lens 8 and reflecting mirror 4 are both projected forward as rays parallel to the optical axis, so that illumination with a high illuminance can be formed at the center region ahead. Light F2 passing between reflecting mirror 4 and Fresnel lens 8 diverges to contribute to the illumination in the nearby surrounding area.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An illumination apparatus projecting light forward, comprising:

a light source;

a first reflecting mirror positioned in front of said light source for receiving light from said light source to project the light forward;

a second reflecting mirror enclosing said light source and said first reflecting mirror for directing and reflecting forward the light from said light source;

a light source-fixing member fixing said light source at a rear end thereof, enclosing said second reflecting mirror, and having an opening in the front end thereof;

a transparent protective cover joined to a front end of said first reflecting mirror to cover said opening of said light source-fixing member, distance varying means including a screw mechanism connecting said protective cover and said light source-fixing member that can vary a distance between said first reflecting mirror and said light source.

2. The illumination apparatus according to claim 1, wherein said second reflecting mirror is a parabolic mirror, and said light source is positioned at a focus of the parbolic mirror.

3. The illumination apparatus according to claim 1, wherein said first reflecting mirror is a small-diameter reflecting mirror having an aperture smaller than that of said second reflecting mirror.

4. The illumination apparatus according to claim 1, wherein said light source is an LED (Light Emitting Diode).

5. The illumination apparatus according to claim 1, wherein said screw mechanism comprises complementary threads at the front end of said light source-fixing member and on said protective cover.

* * * * *